United States Patent [19]

Elliott

[11] Patent Number: 4,961,181

[45] Date of Patent: Oct. 2, 1990

[54] ACOUSTIC TRANSIENT GENERATOR

[75] Inventor: Myron A. Elliott, Panama City, Fla.

[73] Assignee: The United States of America as represented by the Secretary of the Navy, Washington, D.C.

[21] Appl. No.: 388,348

[22] Filed: Aug. 4, 1964

[51] Int. Cl.[5] ..... F42B 22/42; H04K 3/00; B60B 33/08

[52] U.S. Cl. ..... 367/142; 102/402; 116/27; 116/137 R; 116/DIG. 18; 181/120; 367/1

[58] Field of Search ..... 116/27, 137; 114/0.5; 340/12, 5 D; 181/0.5, 0.5 A

[56] References Cited

U.S. PATENT DOCUMENTS

| | | | |
|---|---|---|---|
| 1,507,956 | 9/1924 | DuBois-Reymond | 116/27 |
| 2,699,835 | 1/1955 | Ide | 181/120 |
| 2,901,997 | 9/1959 | Brooks | 116/27 |
| 3,053,220 | 9/1962 | Sawyer | 367/142 |
| 3,056,104 | 9/1962 | DeKanski et al. | 367/142 |
| 3,077,944 | 2/1963 | Padberg | 181/120 |
| 3,083,664 | 4/1963 | Burrell | 367/1 |

*Primary Examiner*—David H. Brown

*Attorney, Agent, or Firm*—Harvey David; John Becker; Sol Sheinbein

[57] ABSTRACT

An underwater transient sound generator for broadcasting optimum acoustical sonic energy in sea water with an appropriate intensity and frequency spectrum to achieve passivation of acoustical mines. A high pressure bubble is released from a chamber while a resilient diaphragm is simultaneously vibrated, the diaphragm having at least one of its surfaces in contact with the sea water. The system provides an improved pneumatic-mechanical impact sound source that produces a controllable distribution of high power, broad band spectrum acoustical energy, to temporarily inactivate acoustical mines, while masking the noise of the ship as it passes the mine.

10 Claims, No Drawings

ACOUSTIC TRANSIENT GENERATOR

The invention described herein may be manufactured and used by or for the Government of the United States of America for governmental purposes without the payment of any royalties thereon or therefor.

The present invention relates generally to sound sources and in particular is an underwater transient generator for broadcasting acoustical energy throughout a subaqueous medium with an appropriate intensity and frequency spectrum for acoustical mine passivation.

In the past, numerous types of sound sources have been employed for broadcasting acoustical energy throughout a predetermined volume of sea water or the like. For example, electroacoustical transducers, explosives, pneumatic transducers, mechanical pressure wave generators, electric spark sound generators, and other well known prior art sound sources have been used for such purpose. However, although those prior art devices are eminently satisfactory for many practical purposes, they leave a great deal to be desired when it becomes necessary to generate and broadcast acoustical energy with a power level and within the unusual frequency range required for passivating an acoustical mine submerged in an aqueous environment such as a sea water mine field. In addition, said prior art sound sources may include such inherent disadvantages as would fall into the difficult logistic and operational problem catagories and, thus, make them impractical for mine passivation purposes.

The present invention overcomes most of the aforementioned prior art disadvantages, in that it facilitates production and propagation of substantially optimum sonic energy for many practical purposes, including the paramount purpose of passivating acoustical mines.

It is, therefore, an object of this invention to provide an improved underwater sound source.

Another object of this invention is to provide a method and means of generating and broadcasting within coincident time periods predetermined high and low frequency acoustical energy in a subaqueous medium.

A further object of this invention is to provide a method of synchronizing the release of contained high pressure air with the impact of a striker on a resilient diaphragm.

A further object of this invention is to provide an improved transient generator for the passivation of acoustical mines.

Another object of this invention is to provide an improved pneumatic-mechanical impact sound source that produces a controllable distribution of high power, broad spectrum acoustical energy.

Still another object of this invention is to provide an improved method and means for masking the noise of a ship as it travels along its course.

Another object of this invention is to provide an improved method and means for repeatedly generating acoustical transients in sea water that will render acoustical mines temporarily inactive and sufficiently passive to effectively protect passing ships from being damaged thereby.

Another object of this invention is to provide a wideband sound source that may be conveniently used in studies of acoustic energy propagation under water.

A further object of this invention is to provide an improved acoustical transducer that may be safely used, presents a minimum of logistic and operational problems, and may be easily and economically manufactured and maintained.

Other objects and many of the attendant advantages will be readily appreciated as the subject invention becomes better understood by reference to the following detailed description when considered in conjunction with the accompanying figures of the drawing wherein.

Figure 1:
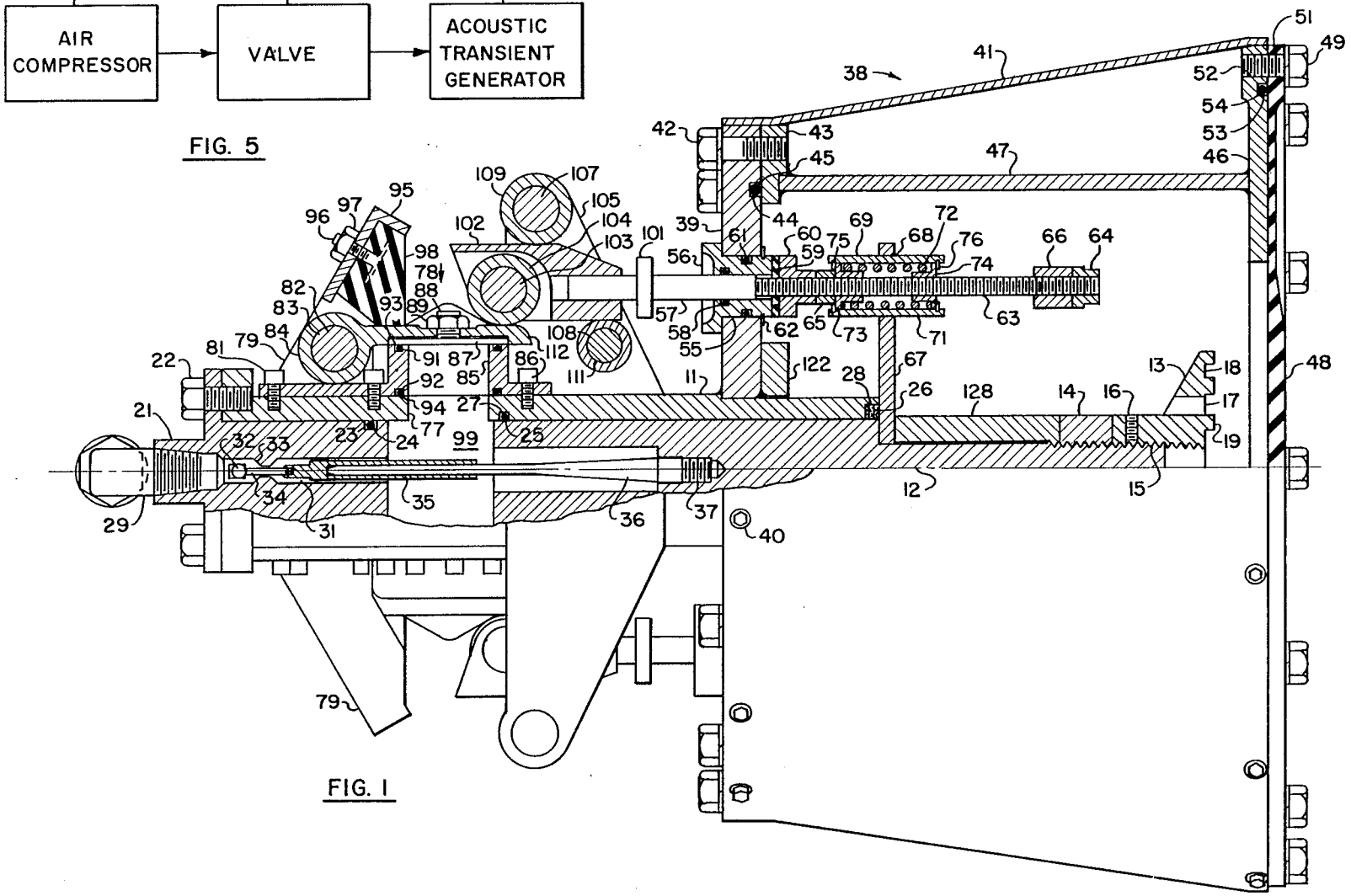
FIG. 1 is a top view of the subject invention with some parts broken away, with some elements shown in cross-section, and with some elements deleted therefrom because they are more clearly shown in FIG. 2.

Referring now to FIG. 1, there is depicted a top view of the subject pneumatic impact acoustic generator as having a cylinder 11 with a piston 12 slidably mounted therein. Attached to one end of said piston is a striker 13 and a spacer 14. For convenience of assembly, said striker and spacer are attached to said piston by means of screw threads 15 and a set screw 16, however, it should be understood that any suitable attachment means may be employed. Holes 17 and grooves 18 are so disposed in striker 13 as to prevent air cushioning from occurring at the impact surface 19 thereof, as will be discussed in more detail subsequently.

An air inlet housing 21 is mounted on the other end of cylinder 11 by means of bolts 22. A resilient o-ring 23 is disposed in a peripherical groove 24 located in said air inlet housing to provide a water tight seal therebetween and cylinder 11. Also, o-ring 25 and oil wick 26 are respectively disposed in inside diameter grooves 27 and 28 of cylinder 11 in order to initially prevent excessive air leakage and provide lubrication therebetween, as the piston slidably moves therewithin.

At one end of housing 21, a fitting 29 is mounted as by screw threads or the like, and attached thereto is an air line 30 adapted to be attached to any appropriate air compressor. Mounted in a hole 31 that longitudinally extends through housing 21 is a ball 32 which abuts against a seat 33 that is preferably formed integrally with housing 21. The combination of ball 32 and seat 33, of course, form an air check valve assembly. Connected to ball 32 is a rod 34 which is also connected to a hollow plunger 35 disposed for slidable movement in the other end of the longitudinal hole in said housing 21. The outside diameter of plunger 35 should be smaller than the inside diameter of hole 31 so air may readily pass therebetween. A check valve release push rod 36 is slidably mounted within the hollow of plunger 35 and is also connected to the end of piston 12 by screw threads 37 or any other suitable conventional means.

Attached to one end of cylinder 11 as by welding or other suitable means is a diaphragm support housing assembly 38. Said housing assembly is preferably composed of a release support header 39, connected by means of bolts 40 or the like to a hollow outer cylinder 41 that may, for example, take the shape of a frustrum of a hollow cone. Bolts 42 secure a corner support 43 to header 39. A circular groove 44 in header 39 contains an o-ring 45 for watertight sealing purposes. The other end of cylinder 41 is supported by a flat ring 46 which, in turn, is mounted on the end of cylinder 47 by welding or other suitable means. A resilient diaphragm 48, preferably of neoprene or an appropriate metal such as phosphor bronze, and possibly of varying thickness to provide greater flexibility without adversely affecting strength characteristics, is mounted on the end of housing 38 by means of bolts 49 extending through holes 51 in the periphery thereof which are screwed into complementary threaded bolt holes 52 disposed in ring 46. Ring 46 also contains a circular groove 53 containing an o-ring 54 to provide a watertight seal thereat. Mounted in an aperture 55, located in header 39, is a bushing 56 through which a slidable trip rod 57 is disposed. Between trip rod 57 and an appropriate groove in bushing 56, an o-ring 58 is disposed. A resilient cushion 59 is mounted between a flanged stop nut 60, which is screwed on rod 57, and the end of bushing 56 to timely act as a buffer therebetween. Likewise, an o-ring 61 is disposed between header 39 and bushing 56 for sealing purposes. A lock ring 62 holds bushing 56 in place in header 39. On the end of trip rod 57 is a threaded portion 63 which has an end lock nut 64 screwed thereon. A pair of stop nuts 65 and 66 are also screwed on rod 57 near the respective extremities of threaded portion 63 thereof.

Laterally mounted on piston 12, as by clamping or other suitable means, is a plate 67, and preferably disposed in a hole 68 therein is a buffer stop mechanism 69 adapted for cushioning the impact therebetween and stops 65 and 66. Such buffer type stop mechanism may, for example, take the form of a hollow cylinder 71 having a spring 72 disposed between a pair of slidable bushing type end-stops 73 and 74, which are prevented from escaping by flange 75 and resilient lock washer 76. Although preferable, buffer mechanism 69 is not absolutely necessary to the operation of the subject invention, as long as hole 68 is large enough to allow trip rod 57 to slide therethrough and small enough to timely butt against resilient stops 65 and 66.

Disposed at the end of piston 12 and in a complementary position therewith in cylinder 11 when these two elements are in their original position, is a relatively large aperture 77, over which is mounted an exhaust valve assembly 78. Included in said exhaust valve assembly is a pair of flanged brackets 79 (only one of which can be seen in FIG. 2) mounted on cylinder 11 by means of screws 81 or the like. Between the bracket portions, a shaft 82 is disposed in holes 83 contained therein and a valve flapper 84 is rotatably mounted on shaft 82. A flanged valve seat 85 is mounted on cylinder 11 surrounding the aforesaid aperture 77 by means of bolts 86. Valve flapper 84 preferably has a metal seat 87 connected thereto by a stud 88 and nut 89 in such manner that seat 87 acts as an adjustable spacer which assists in forming a high pressure air seal between flapper 84 and valve seat 85. To further insure the prevention of air leakage, o-rings 91 and 92 may be inserted in grooves 93 and 94, respectively, of valve seat 85. A bumper plate portion 95 of bracket 79 is attached to and supports by means of studs 96 and nuts 97 a resilient member 98 of rubber or the like which continuously urges valve flapper 84 to a closed-valve position, thereby creating a chamber 99 adapted for being filled with air or some other gaseous fluid under pressure.

The other end of the aforementioned shaft 57 includes a stop flange 101 and a bracket 102 connected to the extremity thereof. A bearing shaft 103 with a roller 104 mounted thereon is attached to bracket 102. Another bracket 105 has a pair of bearing shafts 107 and 108 attached thereto with rollers 109 and 111 mounted thereon in such manner as to act as guide rollers for bracket 102 as it moves back and forth during normal operation. As may readily be seen from FIG. 1 of the drawing, roller 104 is in contact with and is urged toward the direction for traveling up a ramp portion 112 of valve flapper 84 when it is in its closed position.

Figures 2, 3, 4:
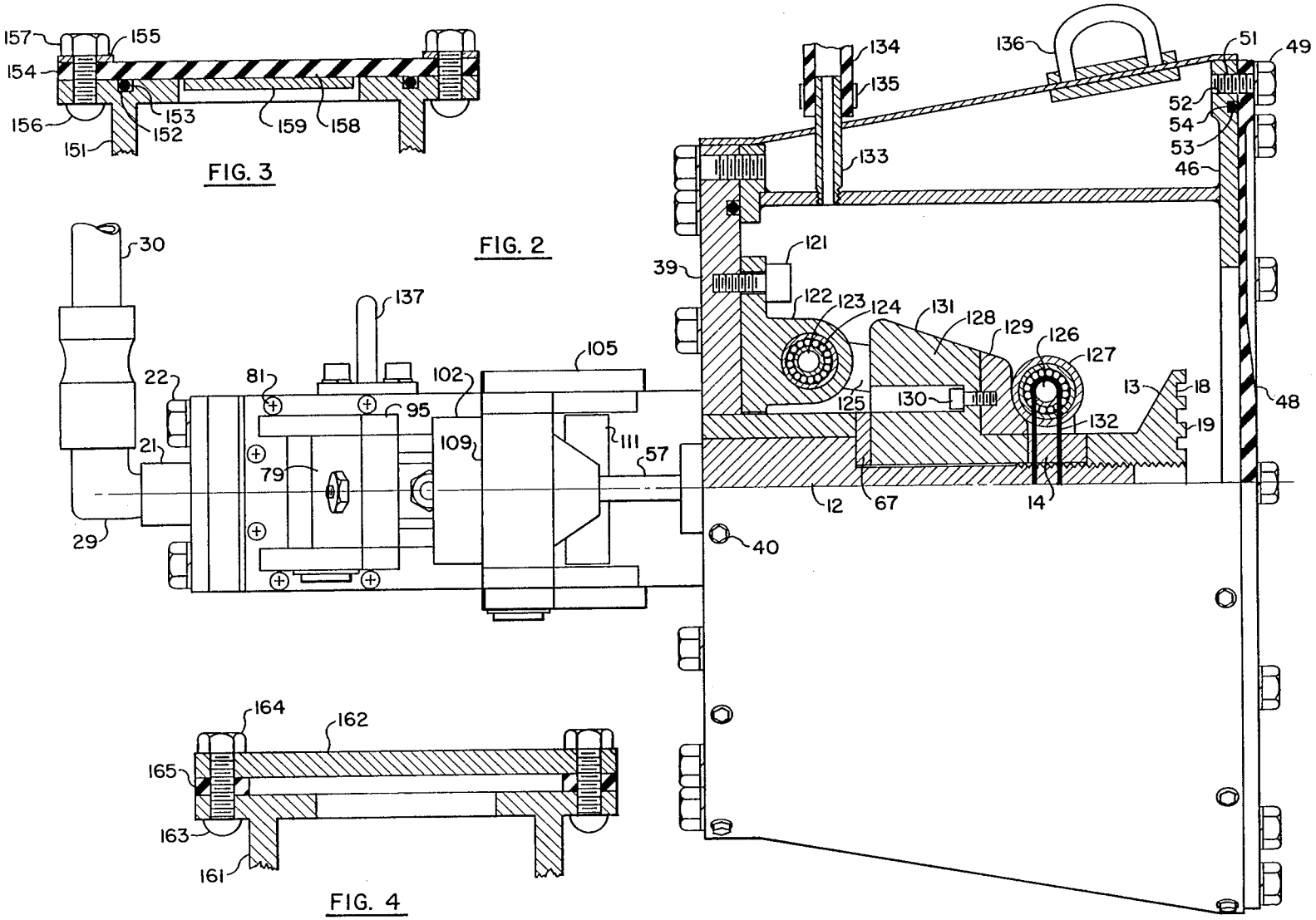
FIG. 2 is a side elevational view of the subject invention with some parts broken away, with some elements shown in cross-section, and with some elements deleted therefrom because they are more clearly shown in FIG. 1.
FIG. 3 illustrates a diagrammatical, cross-sectional representation of another preferred diaphragm assembly that may be incorporated in the subject invention.
FIG. 4 illustrates a diagrammatical, cross-sectional representation of still another preferred diaphragm assembly that may be incorporated in the subject invention.

Referring now to FIG. 2 in particular, attached to header 39 by means of bolts 121 or the like, is a bracket 122 having a bearing shaft 123 mounted thereon. A roller bearing 124 is mounted for rotation on shaft 123 and is also attached to an arm 125 which, in turn, has another shaft 126 and roller 127 mounted thereon at the other extremity thereof. A crossbar support 128 having a shoulder 129 attached thereto by bolts 130, and a sloping ramp portion 131 as an integral portion thereof, is attached to the aforesaid piston 12 for movement therewith.

A flexible, resilient band 132 interconnects bearing shaft 126 and the diametrically opposed comparable bearing shaft (not shown) in such manner that roller 127 is continuously urged toward the longitudinal center axis of the subject device.

A vent pipe 133 is disposed to pass through outer cylinder 41 and inner cylinder 47 in such manner as to have watertight seals thereat. An air line or hose 134 is connected to vent pipe 133 by means of an appropriate clamp 135 and is adapted for being vented to the atmosphere or some other predetermined pressure that is desirable during any given operational circumstance.

A first lifting eye 136 is connected to outer cylinder 41 which may be connected to a cable for lowering and raising and other physical manipulation purposes. Likewise, a second lifting eye 137 is preferably mounted at another suitable support position for similar reasons.

All of the joints included between the various and sundry elements incorporated in this invention are well known and conventional in the art. Hence, as appropriate, they may include welding, bolting, gasketing, etc., as necessary to provide the desired geometrical configuration having the proper strength and watertight sealing characteristics, inasmuch as making such design choices would be well within the purview of one skilled in the art having the benefit of the teachings herewith presented.

Obviously, the parts cut away from each of FIGS. 1 and 2 allow disclosure of most of the foregoing elements, and those portions not having cut-away sections illustrate a representative external view of the device constituting this invention. Those portions showing the external view, of course, also contain similar but oppositely arranged elements as those mentioned above.

FIG. 3 illustrates another preferred embodiment of the diaphragm assembly that may be incorporated in the subject invention.

Instead of a cylinder and ring, as is used in the devices of FIGS. 1 and 2, a flanged cylinder 151 containing a circular groove 152 and an o-ring 153 disposed therein for water sealing purposes is employed. A resilient, flexible diaphragm 154 (rubber, for example) is mounted on the flanged portion of cylinder 151 by means of a metallic ring 155 and bolts 156 and nuts 157, or other conventional, suitable means.

Attached to the central inner surface of diaphragm 154 by means of Chemlock or other suitable adhesive 158 is a metal disc 159, which acts as a siffener therefor at that particular location. This would allow efficient transmission of the impact shock through the rubber into the water and would not be subject to the fatigue failure or permanent deformation that might otherwise occur, especially with metal diaphragms.

FIG. 4, likewise, incorporates a flanged cylinder 161 with a phosphor bronze metal diaphragm 162 effectively connected thereto by means of bolts 163 and nuts 164. However, in this particular preferred embodiment, a thick flexible washer or rubber gasket 165 is inserted between the flanged backing plate portion of cylinder 161 and diaphragm 162 so that it will be raised somewhat therefrom and allow it to vibrate at its resonant frequency after being struck by the striker head.

Diaphragms 154 and 162 are herein depicted as being made of rubber and metal, respectively; however, it should be understood that they may be made of any other suitable material, such as metal, neoprene, plastic, or the like, that provides the desired vibration, resilience, strength, and resonance frequency characteristics.

Of course, the diaphragm of the device of FIGS. 1 and 2 may also be made of materials similar to those mentioned above or of any other preferred suitable material, and assembled with comparable metallic discs or flexible spacer gaskets, if so desired for any given operational circumstances.

The operation of the subject invention will now be discussed briefly in conjunction with FIGS. 1 through 5.

Figure 5:
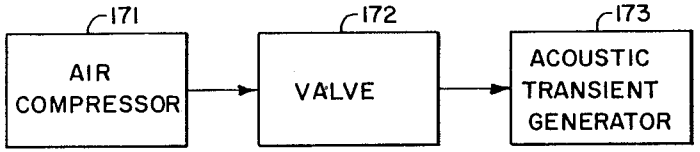
FIG. 5 is a block diagram of an operational system that includes the instant invention.

A typical system in which the instant invention may be employed to an advantage is illustrated in block diagram form in FIG. 5. In this particular case, an air compressor 171 of the type that will produce air or other gaseous fluids at predetermined high pressures, such as, for example, up to 3,000 pounds per square inch, is employed. Such an air compressor may be located on board ship and air line 30 therefrom, after passing through a shutoff valve 172, is lowered within the sea water or other aqueous environment and attached to the subject acoustic transient generator 173 at fitting 29. Accordingly, as may readily be seen, air is timely supplied from said air compressor to operate the acoustic transient generator in such manner that it produces an optimum combination of both high and low frequency acoustical signals at the power level so necessary for the passivation of submerged acoustic mines.

Because the subject acoustic transient generator is capable of intermittant operation as a result of a recocking mechanism inherently included therein, it may be operated on, for all practical purposes, either a predetermined intermittant or substantially continuous basis.

Referring now to the device illustrated in detail in FIGS. 1 and 2, when the aforesaid pressurized air is supplied to fitting 29 it travels through the ball check valve mechanism into chamber 99, the pressure of which builds up to that pressure which is being supplied thereto by the aforesaid air compressor. As the pressure within chamber 99 approaches some predetermined pressure, preferably of the order of 3,000 pounds per square inch, its force upon piston 12 becomes sufficiently great to move the piston 12 toward the right. This movement of piston 12 operates in opposition to the latching force applied by roller 127 against shoulder 129 of cross bar support 128, and as said force exceeds the 3,000 pound per square inch level, roller 127 also overcomes the opposition of resilient band 132, swings outwardly on its rotatable arm 125, and rides upon sloping ramp portion 131. Obviously, roller 127 is maintained at its proper position upon ramp 131 as a result of the continuous resilient urging of band 132 and the connection to rotatable arm 125.

Once the latching mechanism consisting of roller 127, band 132, ramp 131, arm 125 and bearing 123 is, appropriately released, piston 12 continues to accelerate at approximately 1100 g's during its travel, until such time as its striker impacts upon resilient diaphragm 48. Because the striker reaches a velocity of the order of 100 feet per second at the end of a two-inch stroke. Said impact is, of course, of sufficient magnitude to generate high pressure, high frequency acoustic energy at the diaphragm-water interface located on the side of the diaphragm opposite of the piston striker.

However, immediately prior to the instant piston striker 13 impacts upon diaphragm 48, buffer stop mechanism 69, moving along with a piston 12, strikes stop 66 and, thus, moves trip rod 57 in the same direction of travel therewith. As rod 57 moves in a right-hand direction, as it is shown in FIG. 1, roller 104 rolls down and away from ramp 112 of exhaust valve flapper 84 sufficiently to allow said valve flapper to become unlatched from its closed position and rapidly swing off of seat 85, whereby the high pressure air within chamber 99 rapidly escapes in such manner that an explosive pressure is applied to the ambient sea water. Any significant throttling of the air as it is released through the exhaust valve would, of course, reduce the magnitude of the acoustic pulse drastically and, thus, will tend to make the output a single frequency signal that occurs at the resonance frequency of the bubble rather than at the desired broadband frequency. But the type of explosive pressure that results from the operation of the instant exhaust valve arrangement generates acoustical signals within the desired low frequency range so necessary for acoustical mine passivation.

As the air pressure is released from chamber 99, rod 57 continues in its movement in the right-hand direction until it is stopped by flange 101 abutting against the end of bushing 56 that is mounted in release support header 39, attached to stationary cylinder 11. Movement of said rod 57 is guided by means of rollers 109 and 111 as they roll against their respective abutting surfaces of bracket 102.

Immediately after impact surface 19 of striker 13 strikes diaphragm 48, several operations become effective to cause it to automatically return to its original position. One of said operations is the resilient rebounding force of diaphragm 48 itself, and another of such operational factors is the degree of slant of ramp 131 and the pull of resilient band 132 on roller 127, which provides the vectorial force against ramp 131 in the left-hand direction, as roller 127 tends to roll down toward its latched position. Of course, once the rollers pass back over the shoulders of the cross arm support, they gain a high mechanical advantage and exert tremendous force on the piston to secure it in its starting position and hold it there until the pressure in chamber 99 builds back up to 3,000 pounds per square inch.

As the piston returns to its starting position, an opposing force does exist due to the residual air pressure in the high pressure chamber not being completely exhausted after the exhaust valves have been opened. However, after the air bubble formed in the ambient water has expanded, this residual pressure is controlled primarily by the hydrostatic head and the urging of resilient member 98 which constantly tends to close the exhaust valves. Once said air pressure has been dissipated within the surrounding water to a predetermined level, it begins to be overcome by said urging resilient member 98 and flapper 84 is moved to its starting closed valve position. Accordingly, by the time trip rod 57 and roller 104 have reached their incipient return position where they begin to latch flapper 84, ramp 112 thereof is properly located for roller 104 to be rolled thereupon and thus lock valve assembly 78 in a tightly closed condition with a force that exceeds any pressure that may subsequently be built up within chamber 99.

The speed at which the piston returns to its starting position, the synchronizing of this return with the closing of said exhaust valves, and the action of the piston latching mechanism may be controlled and permanently set by adjusting one or more of the following variables: (a) the urging force of resilient member 98; (2) the slope of the ramps of cross bar support 128; (c) the positions of the stop nuts on the trip rods; and (d) the length of the piston stroke. The pressure at which the piston is unlatched and begins to move from its starting position, of course, may be controlled by the configuration and angle of the shoulders of the cross bar support and the tension on the resilient springs or bands 132.

Although bearing loads are high in the subject equipment, they can be handled by commercially available items. It is recommended, however, that self-lubricating bronze bearings be used for any units that may be exposed to salt water and needle bearings be used in dry areas to meet the high loads and low friction requirements of the support arm assembly that locks the piston in its starting position.

As piston 12 originally moved in its right-hand direction toward the diaphragm striking position, the rod 36 connected thereto released the back pressure against ball check valve 32, allowing the valve to close sufficiently to prevent additional high pressure air from entering chamber 99 at this particular time. Then as piston 12 returns to its original starting and latched position, rod 36 encounters the left end of slidable plunger 35 which, in turn, moves shaft 34 and ball 32 to an open position, thereby allowing the high pressure air to again begin to fill chamber 99 and build up sufficiently to again ultimately open exhaust valve 84.

Essentially, the only differences of the device of FIG. 3 and the diaphragm assembly of the device of FIGS. 1 and 2 is that a metallic plate of some preferred design thickness and diameter is cemented to the centrally located position of the interface of the rubber diaphragm in such manner that it is the element that is struck by striker 13 rather than the diaphragm itself.

The device of FIG. 4 incorporates another type of design that will give a lower initial impact into the water but may have more output power over a period of 10 to 20 milliseconds. Mounting the outer edge of a metal diaphragm on a thick flexible gasket (of neoprene or the like) so that the diaphragm is raised from the backing plate allows it to vibrate at its resonance frequency when it is clear of the striker head.

As may be seen, the subject invention operates in such manner that the diaphragm is struck and the exhaust valves are opened at substantially the same time. Of course, due to the transient aspects of the respective signal frequencies produced thereby, for all practical purposes, it may be said that they occur simultaneously or at least that there is sufficient overlapping thereof that they combine to produce broadband, high power acoustical energy that is propagated substantially omnidirectionally toward any given mine type of target, intended to be neutralized. For example, the air pulse may generate sound pressure primarily of frequencies below 100 to 150 cycles per second with an appreciable amount of the energy at the bubble resonance frequency, and sonic energy at the higher frequencies will be generated by the impact of the striker on the diaphragm and by the subsequent vibrations thereof, as well as by the collapse of the cavities formed by the initial impact. It is the combination of these frequencies that is broadcast so effectively through the sea water or other aqueous medium to effect the desired objectives of this invention.

Obviously, many modifications and other embodiments of the subject invention will readily come to the mind of one skilled in the art having the benefit of the teachings presented in the foregoing description in accompaniment with the associated drawings. Therefore, it is to be understood that the invention is not to be limited thereto and that said modification and embodiments are intended to be included within the scope of the appended claims.

What is claimed is:

1. A transducer adapted for generating and broadcasting broadband acoustical energy throughout a predetermined volume of sea water comprising in combination, a resilient diaphragm with one surface thereof exposed to said sea water, means spatially disposed from said diaphragm for the timely striking of the other surface thereof, chamber means contiguously disposed with said diaphragm striking means adapted for having a predetermined air pressure build up therein, valve means attached to said chamber means for timely releasing the air pressure built up therein directly into said sea water, and means connected between said valve means and the aforesaid diaphragm striking means for effecting the opening of said valve means and the striking of said diaphragm at predetermined synchronized times.

2. Means for generating high and low frequency acoustical signals within a broadband frequency spectrum comprising in combination, a diaphragm, means connected to said diaphragm for the support thereof in such manner that said diaphragm will vibrate when energized by a physical force timely applied thereto, a cylinder mounted in and extending through the end of said diaphragm support means that is opposite said diaphragm, a piston slidably mounted in said cylinder for timely engagement with and energization of said diaphragm, a chamber disposed within said cylinder adjacent the end of said piston that is opposite said diaphragm, exhaust valve means mounted on said cylinder for timely opening said chamber to the ambient environment thereof, adjustable latch means effectively interconnecting said piston and said cylinder for timely preventing relative movement therebetween until a predetermined air pressure is contained within said chamber and for timely allowing said piston to slide within said cylinder toward said diaphragm whenever the aforesaid predetermined chamber air pressure occurs, and adjustable means interconnecting said piston and the aforesaid exhaust valve means for opening said valve means after said piston has slidably moved a predetermined distance toward said diaphragm.

3. Means for generating high and low frequency acoustical signals within a broadband frequency spectrum comprising in combination, a diaphragm, means connected to said diaphragm for the support thereof in such manner that said diaphragm will vibrate when energized by a physical force timely applied thereto, a cylinder mounted in and extending through the end of said diaphragm support means that is opposite said diaphragm, a piston slidably mounted in said cylinder for timely engagement with and energization of said diaphragm, a chamber disposed within said cylinder adjacent the end of said piston that is opposite said diaphragm, exhaust valve means mounted on said cylinder for timely opening said chamber to the ambient environment thereof, adjustable latch means effectively interconnecting said piston and said cylinder for timely preventing relative movement therebetween until a predetermined air pressure is contained within said chamber and for timely allowing said piston to slide within said cylinder toward said diaphragm whenever the aforesaid predetermined chamber air pressure occurs, and means interconnecting said piston and the aforesaid exhaust valve means for opening said valve means and releasing the air pressure contained therein to the ambient environment thereof at substantially the same time said slidable piston impacts upon said diaphragm.

4. Means for generating high and low frequency acoustical signals within a broadband frequency spectrum comprising in combination, a diaphragm, means connected to said diaphragm for the support thereof in such manner that said diaphragm will vibrate when energized by a physical force timely applied thereto, a cylinder mounted in and extending through the end of said diaphragm support means that is opposite said diaphragm, a piston slidably mounted in said cylinder for timely engagement with and energization of said diaphragm, a chamber disposed within said cylinder adjacent the end of said piston that is opposite said diaphragm, exhaust valve means mounted on said cylinder for timely opening said chamber to the ambient environment thereof, adjustable latch means effectively interconnecting said piston and said cylinder for timely preventing relative movement therebetween until a predetermined air pressure is contained within said chamber and for timely allowing said piston to slide within said cylinder toward said diaphragm whenever the aforesaid predetermined chamber air pressure occurs, and means connected to said adjustable latch means and said piston for urging said piston away from said diaphragm after it has impacted same.

5. Means for generating high and low frequency acoustical signals within a broadband frequency spectrum comprising in combination, a diaphragm, means connected to said diaphragm for the support thereof in such manner that said diaphragm will vibrate when energized by a physical force timely applied thereto, a cylinder mounted in and extending through the end of said diaphragm support means that is opposite said diaphragm, a piston slidably mounted in said cylinder for timely engagement with and energization of said diaphragm, a chamber disposed within said cylinder adjacent the end of said piston that is opposite said diaphragm, exhaust valve means mounted on said cylinder for timely opening said chamber to the ambient environment thereof, adjustable latch means effectively interconnecting said piston and said cylinder for timely preventing relative movement therebetween until a predetermined air pressure is contained within said chamber and for timely allowing said piston to slide within said cylinder toward said diaphragm whenever the aforesaid predetermined chamber air pressure occurs, means connected to said adjustable latch means and said piston for urging said piston away from said diaphragm after it has impacted same, and air compressor means effectively attached to said cylinder for supplying high pressure air to the aforesaid chamber.

6. Means for generating high and low frequency acoustical signals within a broadband frequency spectrum comprising in combination, a diaphragm, means connected to said diaphragm for the support thereof in such manner that said diaphragm will vibrate when energized by a physical force timely applied thereto, a cylinder mounted in and extending through the end of said diaphragm support means that is opposite said diaphragm, a piston slidably mounted in said cylinder for timely engagement with and energization of said diaphragm, a chamber disposed within said cylinder adjacent the end of said piston that is opposite said diaphragm, exhaust valve means mounted on said cylinder for timely opening said chamber to the ambient environment thereof, adjustable latch means effectively interconnecting said piston and said cylinder for timely preventing relative movement therebetween until a predetermined air pressure is contained within said chamber and for timely allowing said piston to slide within said cylinder toward said diaphragm whenever the aforesaid predetermined chamber air pressure occurs, means connected to said adjustable latch means and said piston for urging said piston away from said diaphragm after it has engaged and energized same, air compressor means effectively attached to said cylinder for supplying high pressure air to the aforesaid cylinder, and means connected between said air compressor means and said chamber for discontinuing the high pressure air being supplied thereto after said piston has slidably moved a predetermined distance toward said diaphragm.

7. An acoustical submarine mine passivation means consisting of an acoustical transient energy generating system comprising in combination, resilient vibratable means having at least one surface thereof in contact with the water in which a submarine mine is submerged, means attached to said resilient vibratable means for the support thereof in such manner that same will vibrate when energized by an impact force timely applied thereto, cylinder means mounted on said resilient vibratable means support means in such manner that an extension of the axis of revolution thereof coincides with the geometrical center of said resilient vibratable means, a piston slidably diaposed in said cylinder in such manner that an appropriate movement thereof will effect its impact upon and energization of said resilient vibratable means, chamber means disposed within said cylinder means adjacent the end of said piston that is opposite said resilient vibratable means, exhaust valve means mounted on said cylinder means for timely opening said chamber means to the water ambient thereto and in proximity with the aforesaid resilient vibratable means, latching means interconnecting said piston and cylinder means for preventing relative movement therebetween until such time that a predetermined air pressure is contained within said chamber means and for timely allowing said predetermined air pressure to force said piston to slide within said cylinder means toward the aforesaid resilient vibratable means, means effectively connected between said piston and said exhaust valve means for the timely opening thereof after said piston has slidably moved a predetermined distance toward said resilient vibratable means, means connected to said latching means, said resilient vibratable support means, and said piston for effecting the timely return of said piston to its latched position after impacting upon the aforesaid resilient vibratable means, an air compressor means effectively connected to said cylinder means for supplying high pressure air to the aforesaid chamber means contained therein, and valve means disposed in said cylinder means between said air compressure means and said chamber means for disconnecting the high pressure air being supplied thereto after said piston has slidably moved a predetermined distance toward said resilient vibratable means.

8. The device of claim 7 wherein said resilient vibratable means comprises a metal diaphragm.

9. The device of claim 7 wherein said resilient vibratable means comprises a rubber diaphragm.

10. The device of claim 7 wherein said resilient vibratable means comprises, a metal diaphragm, and a flexible washer inserted therebetween and said resilient vibratable support means.

* * * * *